US008267503B2

(12) United States Patent
Koyama et al.

(10) Patent No.: US 8,267,503 B2
(45) Date of Patent: Sep. 18, 2012

(54) INK JET RECORDING HEAD AND MANUFACTURING METHOD THEREFOR

(75) Inventors: Shuji Koyama, Kawasaki (JP); Yoshiaki Suzuki, Kawasaki (JP); Satoshi Ibe, Yokohama (JP); Hiroto Komiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1357 days.

(21) Appl. No.: 11/872,383

(22) Filed: Oct. 15, 2007

(65) Prior Publication Data

US 2008/0094454 A1 Apr. 24, 2008

(30) Foreign Application Priority Data

Oct. 16, 2006 (JP) ..... 2006-281291

(51) Int. Cl.
*B41J 2/05* (2006.01)

(52) U.S. Cl. ..... 347/61; 347/54; 347/62

(58) Field of Classification Search ..... 347/54, 347/61, 62

See application file for complete search history.

(56) References Cited

U.S. PATENT DOCUMENTS

| | | | | |
|---|---|---|---|---|
| 5,478,606 | A | 12/1995 | Ohkuma et al. | |
| 5,963,232 | A | 10/1999 | Kasamoto et al. | |
| 6,390,606 | B1 | 5/2002 | Terui et al. | |
| 6,609,783 | B1 | 8/2003 | Koyama et al. | |
| 2006/0098055 | A1 * | 5/2006 | Fujii et al. | 347/65 |
| 2006/0170734 | A1 | 8/2006 | Ibe et al. | |
| 2007/0017894 | A1 * | 1/2007 | Murayama et al. | 216/27 |
| 2007/0178248 | A1 | 8/2007 | Ohsumi et al. | |
| 2007/0207414 | A1 * | 9/2007 | Murayama et al. | 430/311 |
| 2007/0211115 | A1 | 9/2007 | Ibe et al. | |
| 2007/0252872 | A1 * | 11/2007 | Fujii et al. | 347/63 |

FOREIGN PATENT DOCUMENTS

| | | |
|---|---|---|
| JP | 6-286149 | 10/1994 |
| JP | 11-348290 | 12/1999 |
| JP | 2000-043271 | 2/2000 |

* cited by examiner

*Primary Examiner* — Kevin S Wood
(74) *Attorney, Agent, or Firm* — Fitzpatrick, Cella, Harper & Scinto

(57) ABSTRACT

A manufacturing method forms an ink jet recording head including an energy generating element for generating energy for ejecting ink, wiring and electrode pad for supplying electric power to the energy generating element, and a flow path formation member in which an ink flow path is formed in fluid communication with an ink ejection outlet. The method includes steps of preparing a substrate on which the energy generating element, the wiring and the electrode pad have been formed; forming a protection layer covering edges of and around the generating element and the electrode pad; forming, with patterning, an adhesion layer for adhering the flow path formation member to a surface of the substrate through the protection layer, on a portion of the protection layer where the flow path formation member is formed and a portion surrounding the electrode pad; and forming through an electroless plating, a nickel layer covering the electrode pad and a gold layer covering the nickel layer to provide a bump.

8 Claims, 7 Drawing Sheets

(a)

(b) A-A

INK JET RECORDING HEAD AND MANUFACTURING METHOD THEREFOR

FIELD OF THE INVENTION AND RELATED ART

The present invention relates to an ink jet recording head used for an ink jet recording apparatus, and a method for manufacturing an ink jet recording head.

As one of the methods used for recording an image by jetting liquid, there is an ink jet recording method which applies thermal energy to liquid to obtain the force for jetting liquid ink.

In the case of this recording method, as a body of liquid receives thermal energy, it becomes heated and generates bubbles. Thus, the force resulting from the generation of a bubble causes a part of the body of liquid to jet out in the form of a droplet from one of the orifices with which one end of an ink jet recording head is provided. The jetted liquid (ink) droplet adheres to recording medium, effecting a printed form of information, on the recording medium.

Generally, a recording head used by this recording method is provided with a liquid jetting portion, which has multiple orifices for jetting liquid out, and multiple liquid passages. The liquid passages are in connection to the orifices one for one. Each liquid passage is provided a thermal action portion, in which the thermal energy for jetting liquid through the orifice acts on the liquid therein.

The recording head also is provided with multiple heat generating resistor layers, multiple top protection layers for protecting the heat generating resistor layers from ink, and multiple bottom layers for storing heat. The heat generating resistor layers are electrothermal transducers, as the means for thermal energy.

There have been know many methods for manufacturing an ink jet recording head. Some of them are capable of highly precisely and reproducibly setting the distance between each electrothermal transducer and the corresponding ink outlet in an ink jet recording head to be small. Therefore, they can manufacture an ink jet recording head which is capable of recording at a high level of quality.

These manufacturing methods have a step for forming an ink passage pattern using a dissolvable resin, a step for coating covering resin inclusive of such epoxy resin that is solid at the normal temperature, a step for forming ink outlets, and a step for dissolving away the dissolvable resin layer (Japanese Laid-open Patent Application H06-286149).

There has also been known the following ink jet recording head manufacturing method: Heat generating elements having a heat generating resistor for jetting ink are placed on a substrate; the heat generating elements are covered with electrically nonconductive film and tantalum film as a cavitation resistant layer. Then, a liquid passage formation member formed of the covering resin is attached to the substrate bearing the abovementioned components, with an adhesion layer formed of polyether-amide resin, placed between the liquid passage formation member and the substrate (Japanese Laid-open Patent Application H11-348290).

FIGS. 8(*a*) and (*b*) are perspective and sectional views, respectively, of a typical ink jet recording head manufactured with the use of one of the above described conventional manufacturing methods.

FIGS. 9(*a*)-(*f*) are schematic sectional views of the typical ink jet recording head, and show various intermediary states of the ink jet recording head while it is manufactured with the use of the conventional method. One of the methods for forming a bump 6 is disclosed in Japanese Laid-open Patent Application 2000-43271.

The silicon substrate 1 shown in FIG. 9(*a*) is formed of a piece of silicon wafer which is [100] in crystal orientation. Located on the surface of the silicon substrate 1 are multiple energy generating elements 4, such as heat generating resistors, which generate the energy for jetting ink. Located also on the surface of the silicon substrate 1 is a sacrificial layer 3 and a protective layer 5. The sacrificial layer 3 is used for forming a common ink delivery channel 17. The protective layer 5 is formed of SiN, in a manner to cover the energy generating elements 4 and sacrificial layer 3. The back side of the silicon substrate 1 is entirely covered with $SiO_2$ film.

In the next step, the bump 6 is formed on an electrode pad by forming a layer of Ni (nickel) and a replaceable layer of gold, on the electrode pad using an electroless plating.

Next, the method for forming the bump 6 by electroless plating will be described.

First, a substrate having an electrode pad is prepared. What is mandatory regarding the material for this electrode pad is that it contains Al (aluminum). That is, the material for the electrode pad may contain aluminum-silicon alloy, aluminum-copper alloy, etc., in addition to aluminum. Next, the electrode pad is zincated after the removal of the aluminum oxide film, that is, the surface layer, of the electrode pad. Then, the Ni (nickel) layer is formed on the substrate: a layer of zinc having adhered to the surface of aluminum electrode pad is replaced by nickel, and is grown by reduction. Thereafter, the desired bump 6 is completed by forming a substitution layer of gold, in a manner of covering the Ni layer on the aluminum electrode pad.

Next, referring to FIG. 9(*c*), the front and rear surfaces of the silicon substrate 1 are coated with polyether-amide resin to form an adhesion layer 8 and an etching mask layer 9. Then, the polyether-amide resin layers are thermally hardened. As for the method for forming the adhesion layer 8, positive resist is spin-coated on the polyether-amide resin layer, is exposed, and then, is developed. Then, the polyether-amide layer is dry-etched to give the polyether-amide layer a desired pattern. Then, the positive resist is removed.

Then, the etching mask layer 9 (patterned layer of polyether-amide resin) is formed on the back side of the substrate, using the same process as that to which the front surface of the substrate was subjected. That is, positive resist is coated on the polyether-amide layer on the back surface of the substrate by spin-coating or the like method, is exposed, and is developed. Then, the polyether-amide resin layer is etched by dry-etching or the like method to give the polyether-amide layer a preset (desired) pattern. Then, the positive resist is removed, leaving thereby the etching mask layer 9, that is, the polyether-amide layer having a through-hole 2, on the back surface of the silicon substrate 1 as shown in FIG. 9(*c*).

Referring to FIG. 9(*d*), next, positive resist is placed on the surface of the silicon substrate 1, and is patterned to yield molds 11 for the formation of ink passages.

Then, a layer of photosensitive resin, which becomes an ink passage formation member 13, is formed on the molds 11 by spin-coating or the like method. On this layer of photosensitive resin, a water repellent layer 14 is formed by the lamination of dry film, or the like method.

As for the formation of ink outlets 15, preset spots of the surface of the ink passage formation member 13 are exposed with ultraviolet rays, Deep UV rays, or the like, and then developed. Then, holes (ink outlets 15) are made through the ink passage formation member 13.

Next, referring to FIG. 9(*e*), a protection layer 16 is formed by spin-coating or the like method, in a manner to entirely cover the top and lateral sides of the silicon substrate 1, including the molds 11 and ink passage formation member 13 on the silicon substrate 1, that is, except for the back side of the silicon substrate 1.

The $SiO_2$ film 7 on the back surface of the silicon substrate 1 is removed, except for the portions which are not covered with the etching mask layer 9. That is, the etching mask layer 9 is used as the mask for the removal of the $SiO_2$ film 7. The portions of the back surface of the silicon substrate 1, which were exposed by the removal of the $SiO_2$ film, are where the wet-etching of the silicon substrate 1 is started.

Next, the common ink supply channel 17 is formed in the silicon substrate 1 using a chemical etching method, for example, an anisotropic etching method which uses highly alkaline solvent.

Next, referring to FIG. 9(*f*), as the silicon substrate 1 is anisotropically etched from its back surface, the hole created by the etching reaches the sacrificial layer 3 on the front surface of the silicon substrate 1; the common ink supply channel 17, that is, a through hole, which connects the back and front sides of the silicon substrate 1, is effected. Then, the etching mask layer 9 and protective layer 16 are removed.

Further, the molds 11 are dissolved out of the ink outlets 15 and common ink supply channel 17, turning the space which the molds 11 have been occupying, into the ink passages and bubble formation chambers.

After the ink passage formation member 13 having the ink outlets 15 is formed on the silicon substrate 1, the combination of the silicon substrate 1 and ink passage formation member 13 is cut by a dicing saw or the like to yield multiple ink jet recording head chips which have preset size and shape, shown in FIG. 8(*a*).

Then, electrical wiring and the like for driving ink jetting energy generating elements 4 are connected to each ink jet recording head chip. Then, a connective portion for connecting an ink jet recording head chip to an ink container for supplying the ink jet recording head chip with ink is attached to each ink jet recording head chip, completing thereby an ink jet recording head. Incidentally, in the case of some ink jet recording heads, an ink container is an integral part of an ink jet recording head.

The conventional method, described above, for manufacturing an ink jet recording head suffers from the following problems:

That is, when a completed semiconductor chip is subjected to an electroless plating process, electrons leak through the pinholes in the protective layer 5 which covers the electrode pad to protect the electrode pad. Therefore, sometimes, it is difficult to control the electroless plating process in terms of film thickness.

Further, if the aluminum layer is under the pinholes, aluminum sometimes abnormally precipitated. Moreover, for the purpose of preventing this abnormal precipitation of aluminum, a protective layer dedicated to the electroless plating process had to be formed before carrying out the electroless plating process.

SUMMARY OF THE INVENTION

The primary object of the present invention is to provide an ink jet recording head which does not require a protective layer dedicated to the usage of electroless plating process, even if it is manufactured using a manufacturing method which includes the electroless plating process, and a method for manufacturing such an ink jet recording head.

Another object of the present invention is to provide an ink jet recording head which is provided with an adhesion layer for the airtight adhesion between the ink passage formation member and substrate, being therefore superior in the reliability of its bump portions than an ink jet recording apparatus in accordance with the prior art, and a method for manufacturing such an ink jet recording head.

According to an aspect of the present invention, there is provided a manufacturing method for an ink jet recording head including an energy generating element for generating energy for ejecting ink, wiring and electrode pad for supplying electric power to the energy generating element, and a flow path formation member in which an ink flow path is formed in fluid communication with an ink ejection outlet, said manufacturing method comprising a step of preparing a substrate on which said energy generating element, said wiring and said electrode pad have been formed; a step of forming a protection layer covering edges of and around said energy generating element and said electrode pad; a step of forming, with patterning, an adhesion layer for adhering said flow path formation member to a surface of said substrate through said protection layer, on a portion of said protection layer where said flow path formation member is formed and a portion surrounding said electrode pad; a step of forming through an electroless plating, a nickel layer covering said electrode pad and a gold layer covering the nickel layer to provide a bump.

According to another aspect of the present invention, there is provided an ink jet recording head comprising a substrate including thereon an energy generating element for generating energy for ejecting ink, wiring and an electrode pad for supplying electric power to said energy generating element, a flow path formation member having an ink flow path formed in fluid communication with an ink ejection outlet; a first protection layer covering edges of and around said energy generating element and said electrode pad; an adhesion layer, provided at a portion where said flow path formation member is formed, for adhering said flow path formation member to a surface of said substrate through said protection layer; a second protection layer of the same material as said adhesion layer on said first protection layer at a portion surrounding said electrode pad; a bump including a nickel layer covering said electrode pad and a gold layer covering the nickel layer, formed through an electroless plating.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Next, the preferred embodiments of the present invention will be described with reference to the appended drawings.

Figure 1:
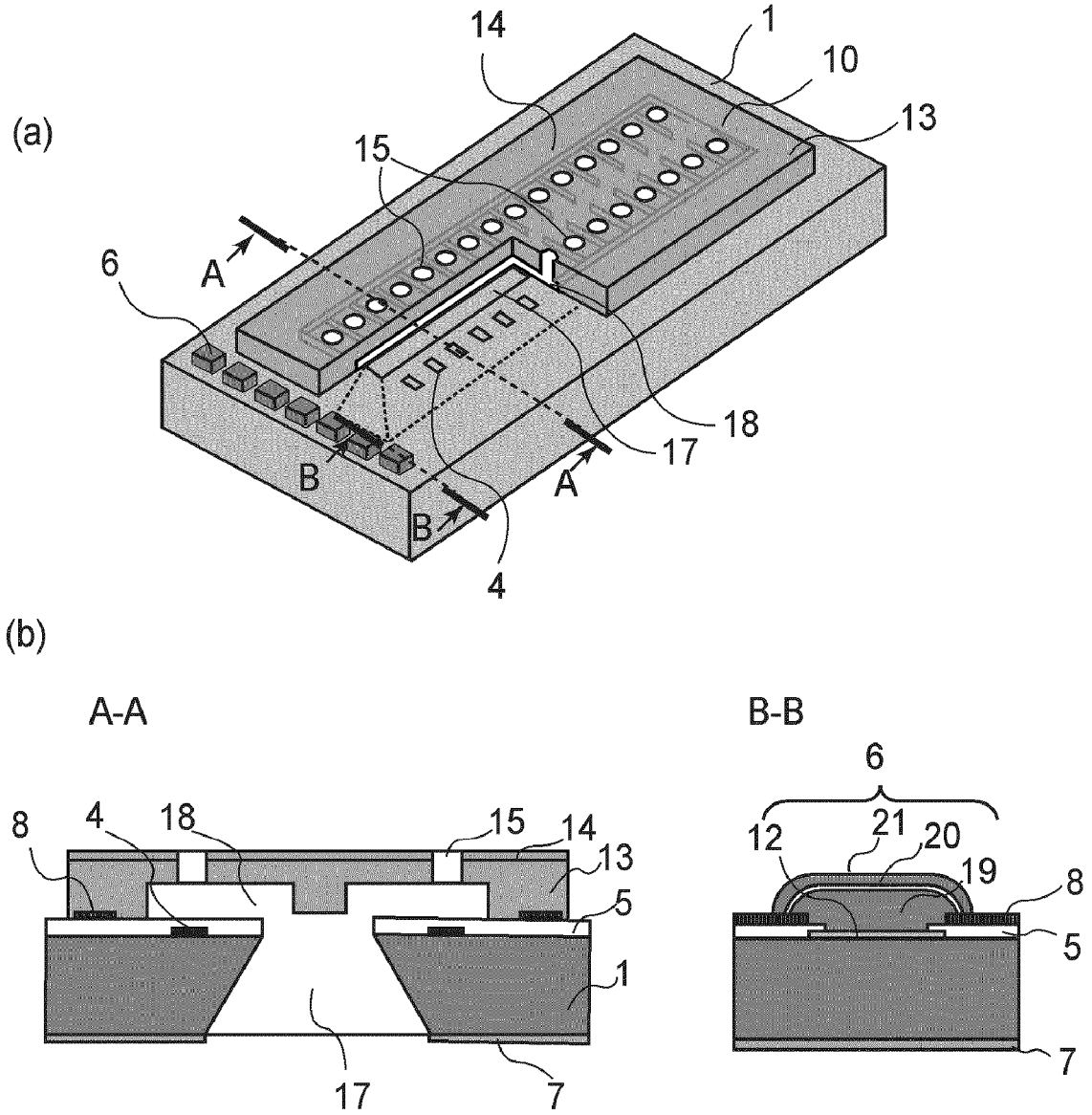
FIGS. 1(*a*) and (*b*) are schematic perspective and sectional views of the ink jet recording head in the first preferred embodiment of the present invention.

FIGS. 1(*a*) and (*b*) are schematic perspective and sectional views, respectively, of the ink jet recording head in the first preferred embodiment of the present invention.

First, the ink jet recording head in this embodiment will be described with reference to FIG. 1(*a*). This ink jet recording head (liquid jetting head) has multiple energy generating elements 4, and a substrate 1 formed of silicon (which hereafter will be referred to simply as silicon substrate). The energy generating elements 4 are formed on the silicon substrate 1, being arranged in two rows at a preset pitch.

The energy generating elements 4 in this embodiment are electrothermal transducers (heaters).

There is an adhesion layer 8 on the top surface of the silicon substrate 1. The adhesion layer 8 is for ensuring that an ink passage formation member 13 (covering member) formed of photosensitive resin remains firmly adhered to the silicon substrate 1. It is formed of polyether-amide resin.

Next, multiple ink outlets 15 (liquid jetting holes) are made through the ink passage formation member 13 and water repellent layer 14, so that the ink outlets 15 formed in the ink passage formation member 13, above the silicon substrate 1, align with the energy generating elements 4 on the silicon substrate 1, one for one.

The ink jet recording head is provided with the common ink supply channel 17 (common liquid supply channel), which was formed by anisotropically etching the silicon substrate 1. In terms of the direction perpendicular to the two rows of ink jetting energy generating elements 4, the top opening of the common ink supply channel 17 is between the aforementioned two rows of ink jetting energy generating elements 4.

This ink jet recording head records by adhering ink droplets to recording medium. More specifically, the pressure generated by the energy generating elements 4 is applied to the ink (liquid) with which the ink passages of the ink jet recording head are filled through the common ink supply channel 17. As a result, ink droplets are jetted out of the ink jet recording head through the ink outlets 15 of the ink jet recording head.

The ink passage formation member 13 is provided with multiple grooves for forming the ink passages, through each of which ink flows from the common ink supply channel 17 to the corresponding ink outlet 15 through the portion of ink passage where the corresponding energy generating element 4 is located.

Next, referring to FIG. 1(*b*), which is a schematic vertical sectional view of the ink jet recording head in this embodiment, at a line A-A in FIG. 1(*a*), the common ink supply channel 17, which is a through-hole for guiding ink into the ink passages, has been formed (etched) through the silicon substrate 1. The energy generating elements 4 (heaters), ink passages 18, and ink outlets 15, which are necessary to jet ink, are on the front (top) side of the silicon substrate 1.

Next, referring to the vertical sectional view (FIG. 1(*b*)) of the ink jet recording head, at the line B-B in FIG. 1(*a*), there is the bump 6 on the silicon substrate 1. The bump 6 is formed by forming a Ni (nickel) layer 19, a substitution gold layer 20, and a reduction gold layer 21 on the electrode pad 12.

This ink jet recording head is usable with a printer, a copying machine, a facsimile machine having a communication system, a word processor or the like having a printer section, and an industrial recording apparatus combined with various processing apparatuses.

With the use of this ink jet recording head, it is possible to record on various recording media, such as paper, yarn, fiber, leather, metal, plastic, glass, lumber, ceramic, etc.

Incidentally, in this specification of the present invention, not only does "recording" mean to form textual and graphical images that have meanings, on recording medium, but also, to form a meaningless pattern on recording medium.

The object of the present invention is to better protect the protection layer 5 by placing the adhesion layer 8, that is, the polyether-amide resin layer placed between the ink passage formation member 13 and silicon substrate 1 to ensure the adhesion between the ink passage formation member 13 and silicon substrate 1, across the areas which are not covered with the adhesion layer 8 in the past. More concretely, in the case of an ink jet recording head in accordance with the prior art, the thermoplastic resin, such as polyether-amide resin, for forming the adhesion layer 8 is coated on the silicon substrate 1, only across the portions which would contact the ink passage formation member 13 if the adhesion layer 8 is not present between the substrate layer 1 and ink passage formation member 13. Therefore, the adhesion layer 8 is present only between the portions of the ink passage formation member 13, which would contact the silicon substrate 1 if the adhesion layer 8 is not present, and the corresponding portions of the silicon substrate 1, which would make contact with the ink passage formation member 13 if the adhesion layer 8 is not present, or the portions of the surface of the silicon substrate 1, which are immediately next to the above-mentioned contact areas between the ink passage formation member 13 and silicon substrate 1. In comparison, in the case of the ink jet recording head in accordance with the present invention, when forming the adhesion layer 8 in the pattern which matches the pattern of the bottom surface of the ink passage formation member 13, the adhesion layer 8 is formed in such a pattern that not only does it cover the protection layer 5, but also, it surrounds the electrode pad, with the presence of no gap.

Incidentally, in the preferred embodiments of the present invention, which will be described next, the etching mask layer 9 is formed on the back (bottom) surface of the silicon substrate 1, using polyether-amide resin, which also is used for forming the adhesion layer 8. This, however, has no direct relation to the protection of the protection layer 5 of the bump 6.

Embodiment 1

Next, the preferred embodiments of the present invention will be described with reference to the appended drawings.

First, referring to FIGS. 2(*a*)-(*f*), the steps for manufacturing the ink jet recording head shown in FIG. 1 will be described.

Figure 2:
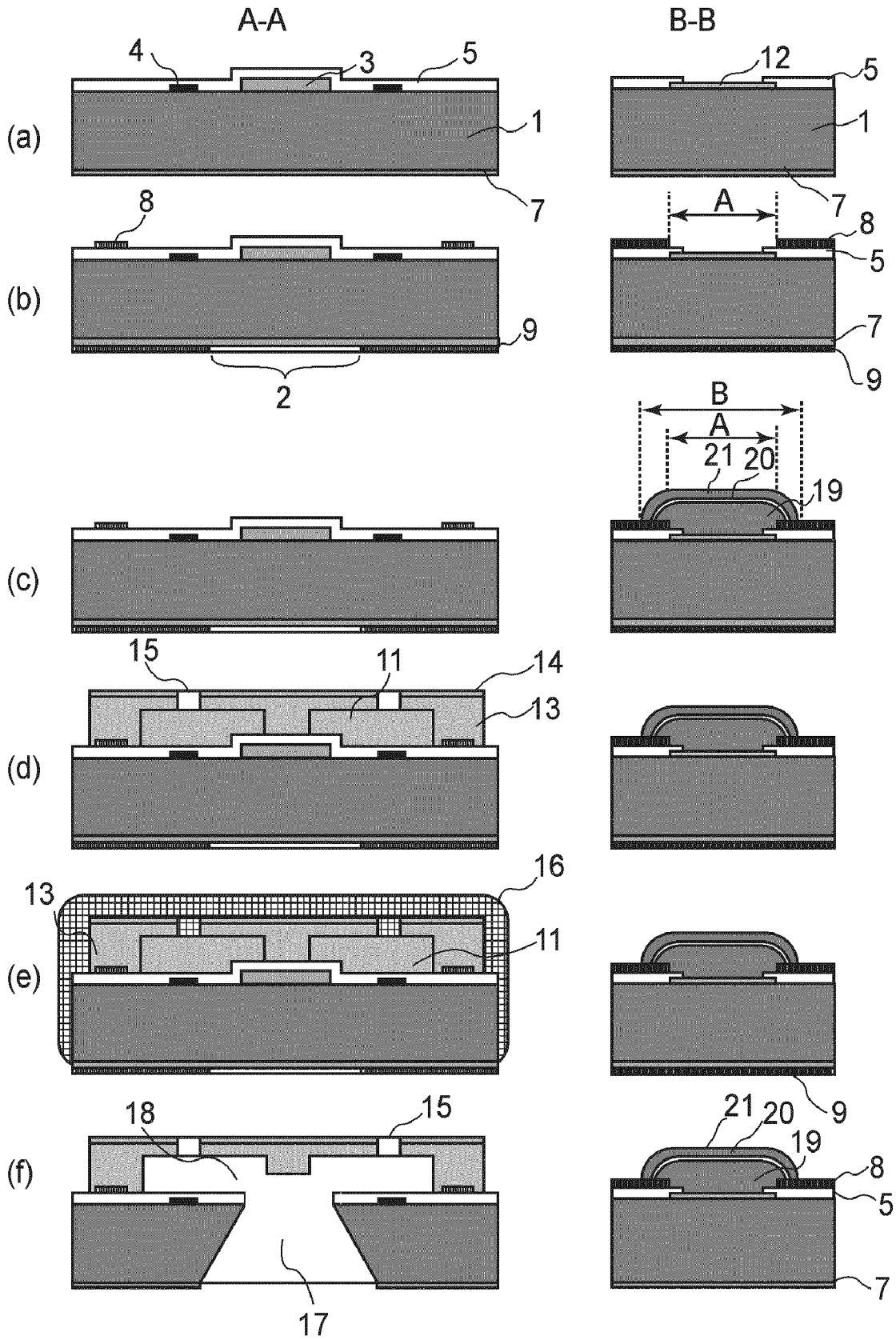
FIGS. 2(*a*)-(*f*) are schematic vertical sectional views of the ink jet recording head, shown in FIG. 1, at lines A-A and B-B in FIG. 1(*a*), showing the states in which the ink jet recording head in the first embodiment are in various intermediary steps for manufacturing the ink jet recording head.

FIGS. 2(*a*)-(*f*) are schematic vertical sectional views of the ink jet recording head, shown in FIG. 1, at lines A-A and B-B in FIG. 1(*a*), showing the states in which the ink jet recording head, in accordance with the present invention, shown in FIG. 1, is in various essential intermediary steps for manufacturing the ink jet recording head.

First, referring to FIG. 2(*a*), multiple energy generating elements 4, such as heat generating resistors, and the sacrificial layer 3 for forming the common ink supply channel 17, are formed on the top surface of the silicon substrate 1. The sacrificial layer 3 is formed of a substance which can be etched with alkaline solution. For example, it is formed of polysilicon. It may be formed of aluminum, aluminum-silicon, copper, aluminum-silicon-copper, or the like, which are faster in etching speed. Then, the protection layer 5 is formed of SiN in a manner to cover the top side of the silicon substrate 1, including the energy generating elements 4 and sacrificial layer 3.

Then, the SiO film 7 is formed across the entirety of the bottom surface of the silicon substrate 1.

Incidentally, the wiring for the energy generating elements 4, and the semiconductor elements for driving the energy generating elements 4, are not shown here.

Referring to FIG. 2(*b*) (at line B-B), the portion of the protection layer 5, which was covering the electrode pad 12, has been removed by patterning, and therefore, the electrode pad 12 formed of aluminum is exposed: aluminum is exposed.

Next, referring to FIG. 2(*b*), polyether-amide resin, which is the material for the adhesion layer 8 and etching mask layer 9, is coated on the top and bottom surfaces of the silicon substrate 1 by spin-coating or the like method, and then, is thermally hardened.

Then, positive resist is coated on the polyether-amide resin layer by spin-coating or the like method, to make a hole through the etching mask layer 9 (polyether-amide layer on bottom surface of the silicon substrate 1), which is used to form the common ink supply channel 17. Then, the positive resist layer is exposed and developed.

Then, the etching mask layer 9 is etched in a preset pattern by dry-etching or the like method, and the positive resist is removed. As a result, the etching mask layer 9 having a through-hole 2 is left on the bottom surface of the silicon substrate 1, as shown in FIG. 2(*b*).

Referring to FIG. 2(*b*) (at line B-B), when forming the pattern for shaping the polyether-amide resin layer into the adhesion layer 8, the pattern is formed so that the portion of the polyether-amide layer, which corresponds in position to the opening (having width of A) for the electrode pad 12, is slightly larger than the electrode pad 12.

Next, referring to FIG. 2(*c*) (at line B-B), the Ni layer 19, substitution gold layer 20, and reduction gold layer 21 are formed on the electrode 12 (aluminum layer) in the listed order by electroless plating. After the completion of this step, the portion of the polyether-amide layer, which will be left as the portion of the adhesion layer 8, which corresponds in position to the electrode pad 12, remains between the protection layer 5 and reduction gold layer 21, between the protection layer 5 and substitution gold layer 20, and also, between the protection layer 5 and Ni layer 9.

At this time, the method for forming the bump 6 by electroless plating will be described.

Referring to FIG. 2(*b*) (at line B-B), the substrate, the top side of which has the electrode pad 12 and the protection layer 5, is prepared. At this stage of manufacturing sequence, the top side of the silicon substrate 1 is virtually entirely covered with the protection layer 5, except for the electrode pad 12 (which remains virtually entirely exposed). As for the material for the electrode pad 12, any substance is acceptable as long as it contains aluminum. For example, aluminum, aluminum-silicon, aluminum-copper, or the like can be used.

Thereafter, oxide film is removed from the exposed surface of the electrode pad 12 (aluminum layer), and then, the new surface of the electrode pad 12 is zincated. Then, the Ni layer 19 is formed on the surface of the electrode pad 12. That is, the Ni layer 19 is formed on the surface of the electrode pad 12 (surface of aluminum layer) by substituting zinc with nickel, and is grown by reduction. Then, the substitution gold layer 20 is formed in a manner to cover the nickel layer 19. Then, the reduction gold layer 21 is formed in a manner to cover the substitution gold layer 20, creating thereby the electrode bump 6 as shown in FIG. 2(*c*) (at line B-B).

The pattern for forming the polyether-amide resin layer into the adhesion layer 8 is designed so that after the patterning of the polyether-amide resin layer, the width A of the hole of the polyether-amide resin layer which corresponds in position to the bump (electrode pad 12) is narrower than the width B of the bump 6.

The bump 6 formed through the electroless plating steps described above was excellent. After the formation of the bump 6, the adhesion layer 8 is present across virtually entirety of the top side of the silicon substrate 1, serving as the top protection layer for the protection layer 5. Therefore, even if the protection layer 5 has pinholes, the pinholes are covered with the adhesion layer 8 (polyether-amide layer), which serves as the top protection layer for the protection layer 5, and therefore, aluminum did not abnormally precipitate.

Figure 9:
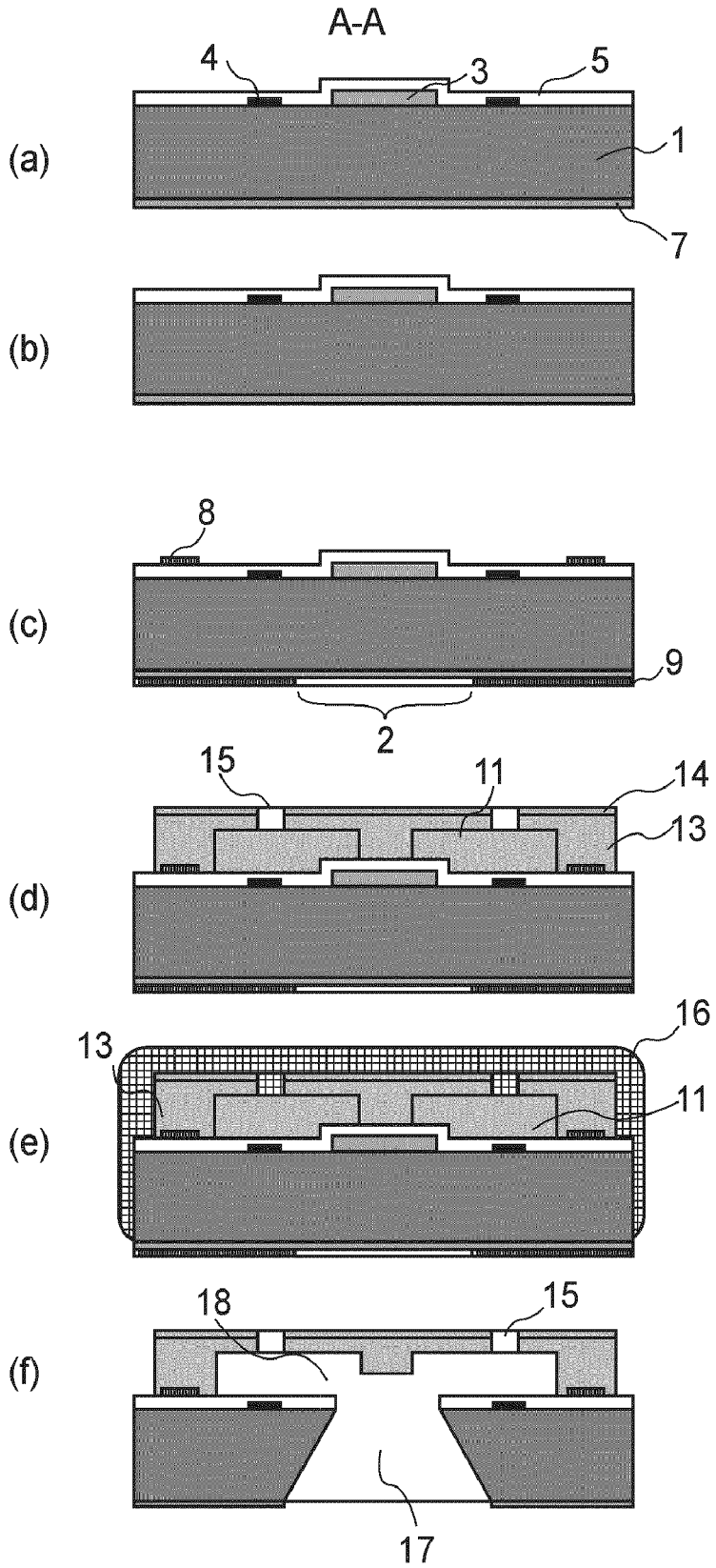
FIGS. 9(*a*)-(*f*) are schematic vertical sectional views of the ink jet recording head in accordance with the prior art, at line A-A in FIG. 8(*a*), showing the states in which the ink jet recording head in accordance with the prior art is in various intermediary steps in the ink jet recording head manufacturing method in accordance with the prior art.

In the following steps shown in FIGS. 2(*d*) (at line A-A)-2(*f*) (at line A-A), the same steps as those described above with reference to FIGS. 9(*d*) (at line A-A)-9(*f*) (at line A-A) are carried out. Even after the completion of these steps for forming the ink passage formation member 13 on the top side (surface) of silicon substrate 1, the shape of the bump 6 remains the same as the shape, shown in FIG. 2(*c*) (at line B-B), in which the bump 6 is, after it was formed by electroless plating through the states shown in FIGS. 2(*a*) (at line B-B)-2(*c*) (at line B-B).

Figure 3:
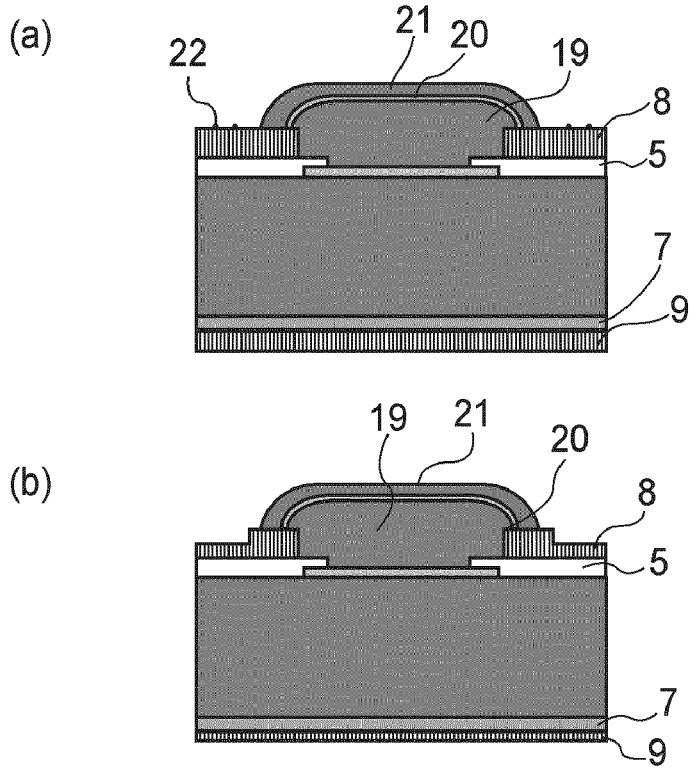
FIGS. 3(*a*) and (*b*) are schematic vertical sectional views of the ink jet recording head in the first embodiment, showing a method for dealing with the precipitate on the adhesion layer.

Incidentally, sometimes, a small amount of gold deposit (gold deposit 22) can be seen on the adhesion layer 8, as shown in FIG. 3(*a*), after the completion of the electroless plating process. This phenomenon seems to be related to the type of polyether-amide resin used to form the adhesion layer 8 and etching mask layer 9.

It is possible that the gold deposit 22 will interfere with the function of the adhesion layer 8 formed of polyether-amide resin, and/or turn into dust by separating from the adhesion layer 8. It may also plug up the nozzles of the ink jet recording head by separating from the adhesion layer 8. Therefore, the gold deposit 22 on the adhesion layer 8 needs to be removed in as early a step as possible in the sequence of the manufacturing steps.

If the gold deposit 22 is (visible) on the adhesion layer 8 (polyether-amide resin layer) as shown in FIG. 3(*a*), it can be efficiently removed with the use of the following two methods.

The first method is as follows: After the completion of the electroless plating process as shown in FIG. 2(*c*) (at line B-B), the adhesion layer 8 (polyether-amide resin layer) is etched away together with the gold deposit 22 by an appropriate thickness. If the gold deposit 22 is present also on the surface of the etching mask layer 9 on the bottom surface of the silicon substrate 1, the same method (first method) can be used to remove the gold deposit 22 to prevent the above described problems attributable to the separation of the gold deposit 22 on the bottom side of the silicon substrate 1.

This method, however, reduces in thickness the adhesion layer 8 (polyether-amide resin layer), because it etches away the adhesion layer 8. Further, if the material for the etching mask layer 9 is the same as that (polyether-amide resin) for the adhesion layer 8, this method reduces in thickness the etching mask layer 9 (polyether-amide resin layer) as well. Therefore, if this method is employed, at least the thickness, by which polyether-amide resin is coated on the top side (surface) of the silicon substrate 1 to form the adhesion layer 8 as shown in FIG. 2(*b*), needs to be greater than the proper thickness for the adhesion layer 8, in consideration of the thickness by which the adhesion layer 8 is etched away to remove the gold deposit 22. This is true with the thickness by which the etching mask layer 9 is formed on the bottom surface of the silicon substrate 1, of the same type of polyether-amide resin as that used as the material for the adhesion layer 8.

Figure 4:
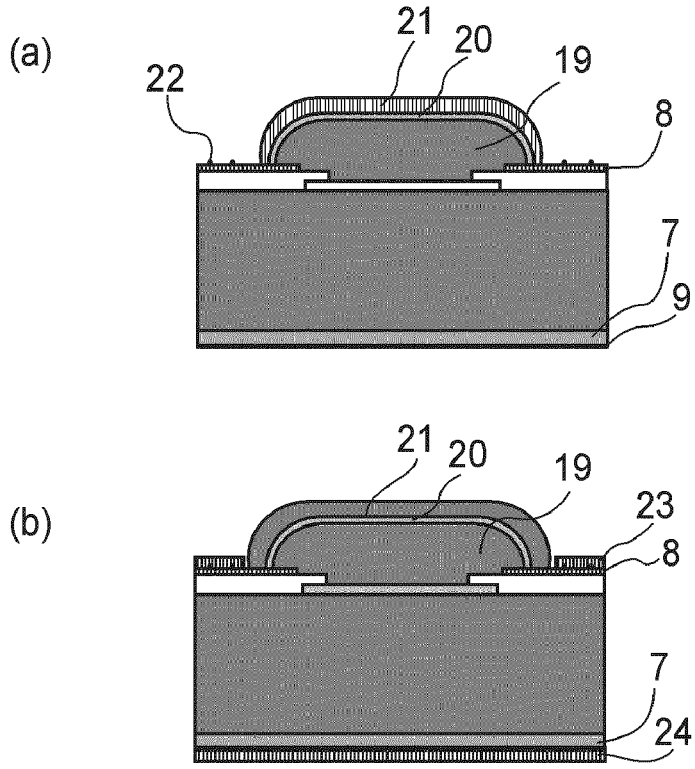
FIGS. 4(*a*) and (*b*) are schematic vertical sectional views of the ink jet recording head in the first embodiment, showing another method for dealing with the precipitate on the adhesion layer.

As for the second method, if gold precipitated on the adhesion layer 8 as shown in FIG. 4(*a*), it is possible to coat the surface of the adhesion layer 8 having the gold deposit 22 with an additional layer of polyether-amide resin to bury the gold 22 in the polyether-amide resin, in order to create a polyether-amide resin layer 23, the surface of which is free of the gold deposit 22. In the case that the etching mask layer 9 had been formed on the bottom surface of the silicon substrate 1, of the polyether-amide resin, and gold had precipitated on the surface of the etching mask layer 9, the gold deposit 22 on the etching mask layer 9 is covered with an additional layer of polyether-amide resin while the additional layer of polyether-amide resin layer is formed on the top side of the silicon substrate 1. Therefore, the gold deposit 22 on the etching mask 9 is also prevented from causing the above described problems attributable to the separation of the gold deposit 22.

In the case of the second method, it is necessary to control the total thickness by which polyether-amide resin layer is coated, by controlling the amounts by which the first layer of polyether-amide resin is coated (FIG. 4(*a*)) and the amount by which the second layer of polyether-amide resin is coated (FIG. 4(*b*)), respectively, so that after the completion of the process which uses the second method, the total thickness of the polyether-amide resin layer ("sum of the thickness of airtight adhesion layer 8 and the thickness of the polyether-amide resin layer 23 formed by second coating" or "sum of the thickness of etching mask layer 9 and the thickness of the polyether-amide resin layer 24 formed by second coating") is correct for the polyether-amide resin layer to properly function as an adhesion layer (8). Also in this case, it is desired that at least the thickness, by which the first layer of polyether-amide resin is coated (to form airtight adhesion layer 8 and etching mask layer 9), is less than those in the preceding cases. That is, it is desired that the thickness, by which polyether-amide resin is coated to form the airtight adhesion layer 8 in the step corresponding to FIG. 4(*a*)(at line B-B) is less than the thickness, by which polyether-amide resin is coated to form the airtight adhesion layer 8 in the step corresponding to FIG. 2(*b*) (at line A-A), for example. Thereafter, the second layer of polyether-amide resin is coated by the thickness that make the total thickness of the resultant layer of polyether-amide resin equals that of the adhesion layer 8 shown in FIGS. 2(*c*) (at line B-B)-2(*f*) (at line B-B).

As described above, even if gold precipitates (even if gold deposit 22 is visible), either of the two methods described above can effectively control the adverse effects which the gold deposit 22 has upon the steps which come after the electroless plating step.

Further, the usefulness of the above described two methods is not limited to deal with the gold deposit 22 described above. That is, even if inorganic substances other than gold, or organic substances adhere to the adhesion layer 8 and/or etching mask layer 9, either of the two methods can effectively prevent the substances on the layers 8 and 9 from adversely affecting the manufacturing steps which come after the plating.

After the completion of the ink passage formation member 13, ink outlets 15, energy generating elements 4, etc., on the silicon substrate 1 through the sequence of steps described above, the silicon substrate 1 is cut by a dicing saw or the like, being separated into individual ink jet recording head chips. Then, the electrical connection for driving the ink jetting energy generating elements 4 is made, and each chip is provided with a connective portion by which it is connected to an ink container for supplying the chip with ink. This completes the ink jet recording head.

Embodiment 2

Next, the other preferred embodiments of the present invention will be described with reference to the appended drawings. Here, the steps for making the ink jet recording head shown in FIG. 1 will be described with reference to FIGS. 5(*a*)-5(*f*).

Figure 5:
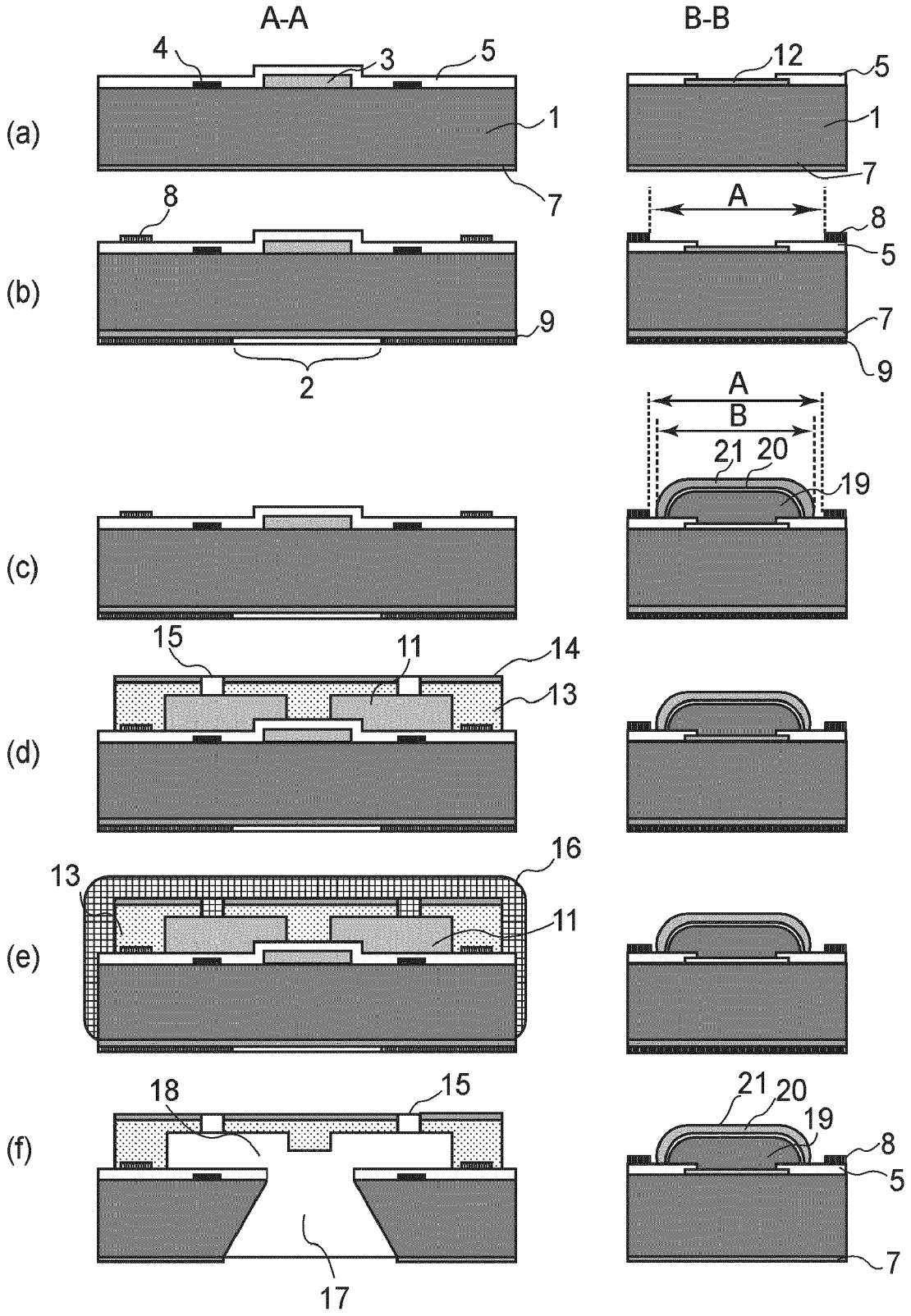
FIGS. 5(*a*)-(*f*) are schematic vertical sectional views of the ink jet recording head, shown in FIG. 1, at lines A-A and B-B in FIG. 1(*a*), showing the states in which the ink jet recording head is in various intermediary steps in the ink jet recording manufacturing method in the second embodiment of the present invention.

FIGS. 5(*a*)-5(*f*) correspond to the lines A-A and B-B in FIG. 1(*a*). They are schematic sectional views of the ink jet recording head shown in FIG. 1, showing the essential steps through which the ink jet recording head is manufactured.

The manufacturing steps in this embodiment, which correspond to FIGS. 5(*a*) (at line A-A)-5(*f*) (at line A-A), which are sectional views of the ink jet recording head chip, are the same as those of the manufacturing steps in the first embodiment, which correspond to FIGS. 2(*a*) (at line A-A)-2(*f*) (at line A-A). Therefore, they will be not described here.

The difference of this embodiment from the first one is in that in the step corresponding to FIG. 5(*b*), which is a sectional view of the ink jet recording head chip, at line B-B in FIG. 1(*a*), the width A of the pattern for forming the adhesion layer 8 of the polyether-amide resin layer is made greater than the width A of the pattern for forming the adhesion layer 8 of the polyether-amide resin layer in the step corresponding to FIG. 2*b* (at line B-B). In this embodiment, therefore, the adhesion layer 8 formed of polyether-amide resin is not present under the reduction gold layer 21 and substitution gold layer 20. That is, the edge of the polyether-amide resin layer (adhesion layer 8), on the electrode pad side, is not in contact with the reduction gold layer 21, and therefore, the protection layer 5 remains exposed between the reduction gold layer 21 and the edge of the polyether-amide resin layer. Incidentally, the electroless plating process used for forming the bump 6 in this embodiment is the same as the one used in the steps corresponding to FIG. 2(*b*) (at line B-B)-2(*c*) (at line B-B), in the first embodiment. That is, in the step corresponding to FIG. 5(*c*) (at line B-B), the height of the bump 6, and the width A of the hole with which the adhesion layer 8 (formed of polyether-amide resin) is provided to form the bump 6, are set so that the width B of the bump 6 is less than the width A.

The bump 6 formed by electroless plating through the steps described above was excellent. The adhesion layer 8 is present across virtually entirety of the top surface of the chip, serving as the protection layer for protecting top side of the protection layer 5. Therefore, even if the protection layer 5 has pinholes, the pinholes are covered with the adhesion layer 8 (polyether-amide layer), which serves as the top protection layer for the protection layer 5, and therefore, aluminum did not abnormally precipitate. In this embodiment, unlike in the first embodiment, the portion of the protection layer 5, which is between the adhesion layer 8 (form of polyether-amide resin) and reduction gold layer 21, is not covered with the polyether-amide resin layer, as is evident from FIG. 5(*c*), for example. However, the distance between this portion of the protection layer 5 and the electrode pad 12 makes it difficult for the ions in ink to permeate into electrode pad 12. Therefore, the same effects as those described above can be achieved.

Also in this embodiment, a phenomenon similar to the phenomenon described regarding the first embodiment with reference to FIG. 3(*a*), and also, FIGS. 4(*a*) and 7(*a*), sometimes occurs. That is, a small amount of gold deposit (gold deposit 22) can be seen on the adhesion layer 8, as shown in FIG. 6(*a*), after the completion of the electroless plating process.

It is possible that the gold deposit 22 will interfere with the function of the adhesion layer 8 formed of polyether-amide resin, and/or turn into dust by separating from the adhesion layer 8. Further, it is possible for the gold deposit 22 to plug up the nozzles of the ink jet recording head by separating from the adhesion layer 8. Therefore, also in this embodiment, the gold deposit 22 on the adhesion layer 8 needs to be dealt with in as early a step as possible in the sequence of the manufacturing steps.

Figure 6:
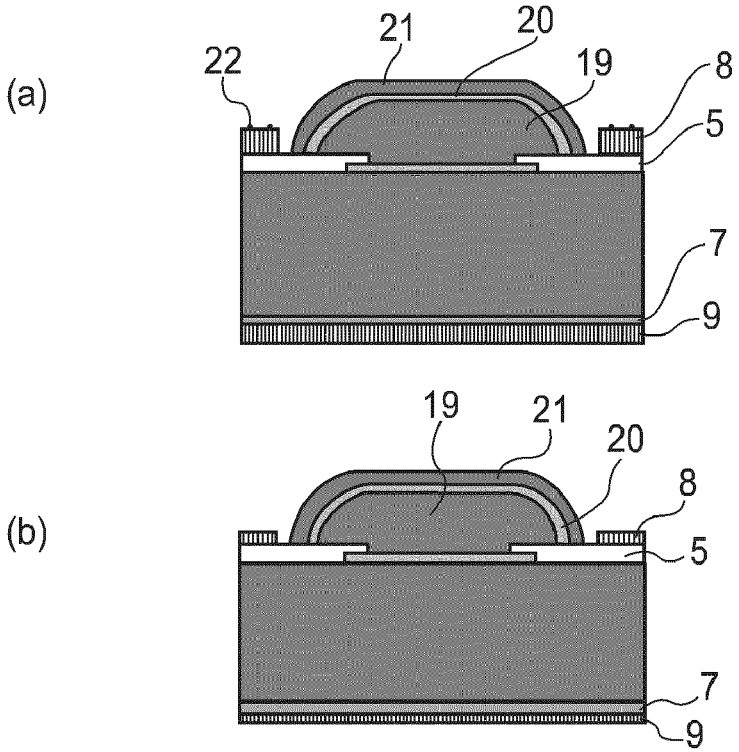
FIGS. 6(*a*) and (*b*) are schematic vertical sectional views of the ink jet recording head shown in FIG. 1, showing a method, in the second embodiment, for dealing with the precipitate on the adhesion layer.

If gold deposit 22 is (visible) on the polyether-amide resin layer as shown in FIGS. 6(*a*) and 7(*a*), the gold deposit 22 can be efficiently dealt with by either of the following two methods (FIGS. 6(*a*)-7(*b*)), which are similar to the two methods used for dealing with the gold deposit 22, in the first embodiment, which are described with reference to FIGS. 3(*a*)-4(*b*) referenced for the description of the first embodiment.

The difference between the steps corresponding to FIGS. 3(*a*)-4(*b*) referenced for the description of the first embodiment, and the steps corresponding to FIGS. 6(*a*) and 7(*b*) which are the sectional views of the ink jet recording head chip in the second embodiment, comes from whether the edge of the adhesion layer 8 for protecting the bump 6 is below the nickel layer 19, substitution gold layer 20, and reduction gold layer 21, or the edge of the adhesion layer 8 is away from the bump 6, being not in contact with even the reduction gold layer 21. Otherwise, the second embodiment is the same as the first embodiment.

This method is as follows: After the completion of the electroless plating process as shown in FIG. 5(*c*) (B-B), the adhesion layer 8 (polyether-amide resin layer) is etched away together with the gold deposit 22 by an appropriate thickness, as shown in FIGS. 6(*a*)-6(*b*). If gold deposit 22 is present also on the surface of the etching mask layer 9 on the bottom surface of the silicon substrate 1, the same method (first method) can be used to remove the gold deposit 22 to prevent the above described problems attributable to the separation of the gold deposit 22 on the bottom side of the silicon substrate 1.

This method, however, reduces in thickness the polyether-amide resin layer because it etches away the polyether-amide resin layer. Therefore, if this method is employed, at least the thickness, by which polyether-amide resin is coated on the top surface of the silicon substrate 1 to form the adhesion layer 8 in the step corresponding to FIG. 5(*b*), needs to be greater than the proper thickness, in consideration of the thickness by which the polyether-amide resin layer is etched to remove the gold deposit 22.

Figure 7:
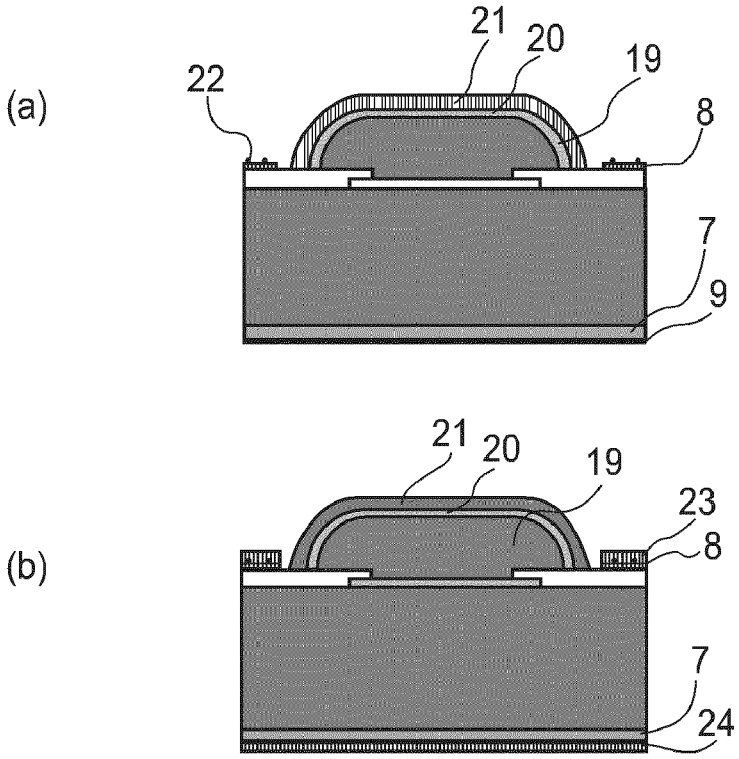
FIGS. 7(*a*) and (*b*) are schematic vertical sectional views of the ink jet recording head, shown in FIG. 1, showing another method, in the second embodiment, for dealing with the precipitate on the adhesion layer.
Figure 8:
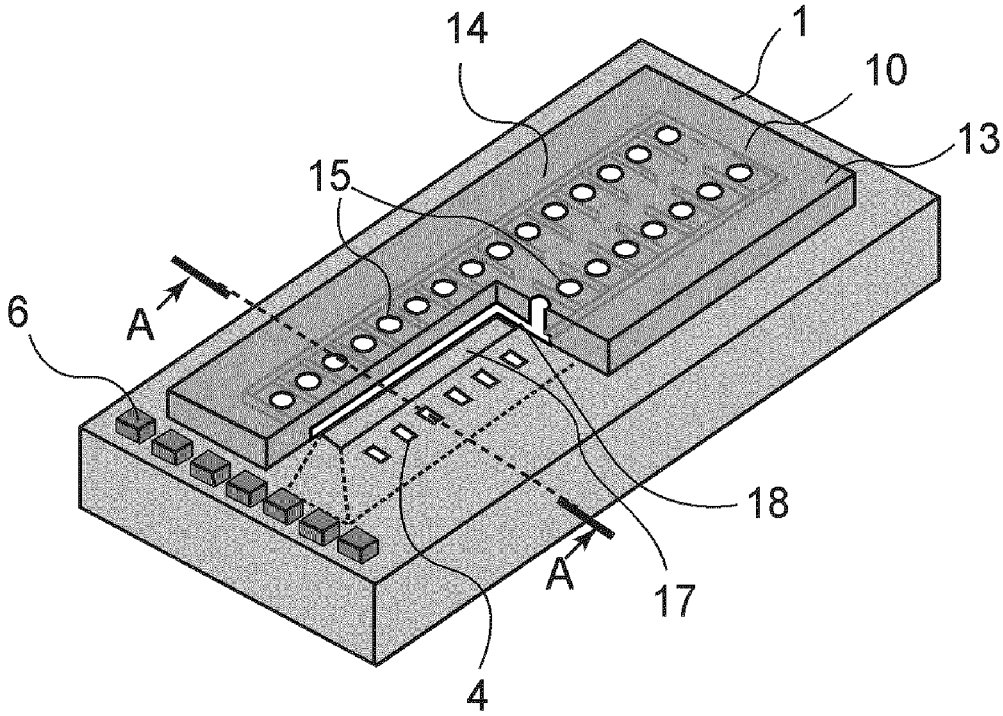
FIGS. 8(*a*) and (*b*) are schematic perspective and sectional views of a typical ink jet recording head in accordance with the prior art.
Figure 8:
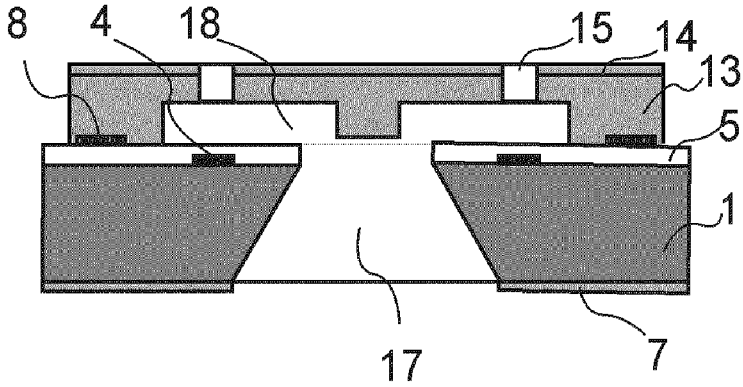

As for the second method, if gold 22 precipitated on the adhesion layer 8 as shown in FIG. 7(*a*), it is possible to coat (laminate) the surface of the adhesion layer 8 having the gold deposit 22 with an additional layer of polyether-amide resin to bury the gold deposit 22 in the polyether-amide resin, in order to create a polyether-amide resin layer 23, the surface of which is free of the grains of gold 22. Further, if gold 22 precipitates on the surface of the etching mask layer 9 formed on the bottom surface of the silicon substrate 1, of the polyether-amide resin, the gold deposit 22 on the etching mask layer 9 is covered with another layer 24 of polyether-amide resin. Therefore, the gold deposit 22 on the etching mask 9 is prevented from causing the above described problems attributable to the separation of the gold deposit 22.

In the case of the second method, it is necessary to control the total thickness, by which polyether-amide resin layer is coated, by controlling the thickness, by which the first coat of polyether-amide resin is coated (FIG. 7(*a*)) and the second coat of polyether-amide resin is coated (FIG. 7(*b*)), respectively, so that at least the thickness, by which the first coat of polyether-amide resin is coated, is less than the thickness of the polyether-amide resin layer shown in FIG. 5(*b*) (at line B-B).

As described above, even if gold precipitates (even if gold deposit 22 is visible), either of the two methods described above can effectively control the adverse effects which the gold deposit 22 has upon the steps which come after the electroless plating step.

Further, the usefulness of the above described two methods is not limited to deal with the gold deposit 22 described above. That is, even if inorganic substances other than gold, or organic substances adhere to the adhesion layer 8 and/or etching mask layer 9, either of the two methods can effectively prevent the substances on the layers 8 and 9 from adversely affect the manufacturing steps which come after the plating step.

After the formation of the ink passage formation member 13, ink outlets 15, energy generating elements 4, etc., on the silicon substrate 1 through the sequence of steps described above, the silicon substrate 1 is cut by a dicing saw or the like, being separated into individual ink jet recording head chips. Then, the electrical connection for driving the ink jetting energy generating elements 4 is made, and each chip is provided with a connective portion by which it is connected to an ink container for supplying the chip with ink. This completes the ink jet recording head.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 281291/2006 filed Oct. 16, 2006, which is hereby incorporated by reference herein.

What is claimed is:

1. A manufacturing method for an ink jet recording head including an energy generating element for generating energy for ejecting ink and an electrode pad for supplying electric power to the energy generating element, and a flow path formation member in which an ink flow path is formed in fluid communication with an ink ejection outlet, said manufacturing method comprising:

a step of providing a substrate on which the energy generating element and the electrode pad have been formed;

a step of forming a protection layer covering the energy generating element and edges of the electrode pad;

a step of forming, with patterning, an adhesion layer for adhering the flow path formation member to the protection layer on the substrate, the adhesion layer being formed on a portion of the protection layer where the flow path formation member is to be formed and a portion surrounding the electrode pad; and a step of forming through electroless plating, a nickel layer covering the electrode pad and a gold layer covering the nickel layer to provide a bump.

2. A method according to claim 1, wherein in said adhesion layer forming step, the adhesion layer covers the protection layer surrounding a circumference of the electrode pad so that a width of the adhesion layer is smaller than a width of the bump, to extend the adhesion layer between the gold layer and the protection layer.

3. A method according to claim 1, wherein in said adhesion layer forming step, the adhesion layer covers the protection layer surrounding a circumference of the electrode pad so that the adhesion layer does not contact the gold layer and so that a width of the adhesion layer is greater than a width of the bump.

4. A method according to claim 1, wherein the adhesion layer is made of a thermoplastic resin material.

5. A method according to claim 4, wherein the thermoplastic resin material includes a polyetheramide resin material.

6. A method according to claim 1, wherein the gold layer comprises a layer formed by substitution and a layer formed by reduction and covering the layer formed by substitution, which are formed sequentially by the electroless plating.

7. A method according to claim 1, further comprising a step of increasing the thickness of the adhesion layer formed at the portion surrounding the electrode pad.

8. A method according to claim 1, further comprising a step of decreasing the thickness of the adhesion layer formed at the portion surrounding the electrode pad.

* * * * *